US010866052B2

(12) United States Patent
Berean

(10) Patent No.: US 10,866,052 B2
(45) Date of Patent: Dec. 15, 2020

(54) APPARATUS AND METHOD TO REDUCE MUZZLE RISE IN A FIREARM

(71) Applicant: Vincent Tactical LLC, Chittenango, NY (US)

(72) Inventor: Kyle J. Berean, Chittenango, NY (US)

( * ) Notice: Subject to any disclaimer, the term of this patent is extended or adjusted under 35 U.S.C. 154(b) by 0 days.

(21) Appl. No.: 16/114,209

(22) Filed: Aug. 27, 2018

(65) Prior Publication Data

US 2020/0025499 A1 Jan. 23, 2020

Related U.S. Application Data

(60) Provisional application No. 62/550,579, filed on Aug. 26, 2017.

(51) Int. Cl.

| | |
|---|---|
| ***F41A 21/36*** | (2006.01) |
| ***F41C 27/22*** | (2006.01) |
| *F41C 7/00* | (2006.01) |

(52) U.S. Cl.

CPC ..... *F41A 21/36* (2013.01); *F41C 27/22* (2013.01); *F41C 7/00* (2013.01)

(58) Field of Classification Search

CPC ..... F41A 9/17; F41A 9/19; F41A 9/23; F41A 21/36; F41A 21/38; F41C 27/22

See application file for complete search history.

(56) References Cited

U.S. PATENT DOCUMENTS

| | | | | |
|---|---|---|---|---|
| 4,821,442 A * | 4/1989 | Bock | F41A 9/72 | 42/17 |
| 5,235,769 A * | 8/1993 | Stead | F41A 9/17 | 42/11 |
| 5,367,810 A * | 11/1994 | Stead | F41A 9/72 | 42/17 |
| 2013/0081314 A1* | 4/2013 | Hatfield | F41A 9/72 | 42/1.02 |
| 2015/0096213 A1* | 4/2015 | Potter | F41A 9/23 | 42/17 |

* cited by examiner

*Primary Examiner* — Bret Hayes
(74) *Attorney, Agent, or Firm* — Barry F. Manna

(57) ABSTRACT

A firearm having reduced muzzle rise is disclosed. The firearm includes a barrel having a breech end, an opposing muzzle end, and a bore defining a barrel centerline which, when extended in a longitudinal direction, defines a barrel axis. The firearm further includes a magazine tube disposed above the barrel, a receiver defining a lower opening to receive the barrel, and an upper opening to receive the magazine tube. The firearm further includes a stock defining a body support surface where the stock braces against a user's body. The barrel axis passes through the body support surface of the stock.

14 Claims, 9 Drawing Sheets

APPARATUS AND METHOD TO REDUCE MUZZLE RISE IN A FIREARM

Reference is made to and this application claims priority from and the benefit of U.S. Provisional Application Ser. No. 62/550,579, filed Aug. 26, 2017, entitled "FIREARM HAVING REDUCED MUZZLE RISE", which application is incorporated herein in its entirety by reference.

FIELD OF THE INVENTION

This disclosure relates generally to firearms and, more specifically, to reducing the muzzle rise in a firearm.

BACKGROUND OF THE INVENTION

When a round is discharged from a firearm, the forward momentum of the projectile and exhaust gases must be balanced by forces equal in magnitude and opposite in direction (Newton's third law). The resultant forces, directed along the gun barrel towards the user, cause the firearm to recoil. Recoil in a firearm refers to its backwards motion when a round is discharged. For small firearms, the backwards motion or recoil is typically absorbed and arrested by the user's body.

Muzzle rise refers to the motion of a firearm barrel as it jerks upwards when a shot is fired. FIG. 1 depicts a prior art shotgun 10 and a free body diagram to illustrate the forces at play when the shotgun is fired. The force P from the projectile and propellant gases act on the barrel 11 along the barrel centerline 12. The force P is resisted at the location where the shotgun stock 13 contacts the shoulder support of the user, designated by an average reacting force S. The difference in height H between the force P acting along the barrel axis 14 and the reacting force S at the average point of user contact operates to create a torque, or moment M. The moment M operates to rotate the muzzle end 15 of the barrel upwards, as shown by muzzle rise arrow MR.

Recoil and muzzle rise create several deleterious effects for the user. For example, the upwards jerking motion can throw the user off balance, or cause the user to lose control of the firearm. The muzzle rise also increases the user's follow up time, which increases the time to get back on target. Depending on the amount of pressure and power in the round, and thus the magnitude of the recoil and muzzle rise, even an experienced user may have difficulty quickly following up a shot.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
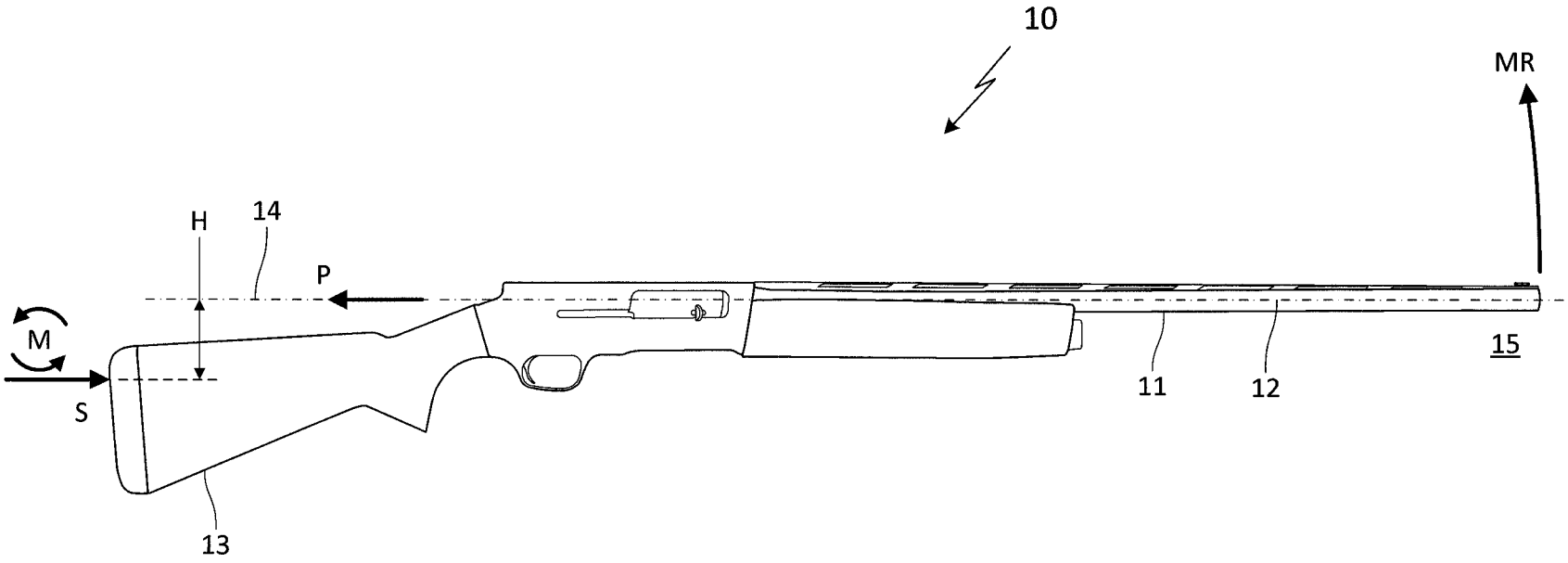
FIG. 1 PRIOR ART
FIG. 1 depicts a side plan view of prior art shotgun.

The present invention mitigates these deleterious effects by aligning the barrel axis of the firearm with the user support surface on the stock or grip. As will be explained in detail below, by reducing or eliminating the difference in height H between the force P acting along the barrel axis and the reacting force S at the average point of user contact, little to no torque is generated and the muzzle rise MR is all but eliminated. However, in order to properly align the barrel with the contact point of the user, the layout of other components in the firearm had to be reconfigured. Specifically, the barrel had to be lowered relative to the stock as far as possible. One method by which this was accomplished was to switch the locations of the magazine tube and the barrel. A typical prior art shotgun, as shown in FIG. 1, positions the magazine tube 16 underneath the barrel 11. However, in some embodiments of the present invention, the magazine tube is repositioned on top of the shotgun, and the barrel is moved underneath the magazine tube. This relocation also necessitated a redesign of the shot shell loading and ejection mechanisms. Another method by which the barrel was lowered relative to the stock was to form a longitudinal internal cavity in the fore stock, and position the barrel within the cavity.

Figure 2:
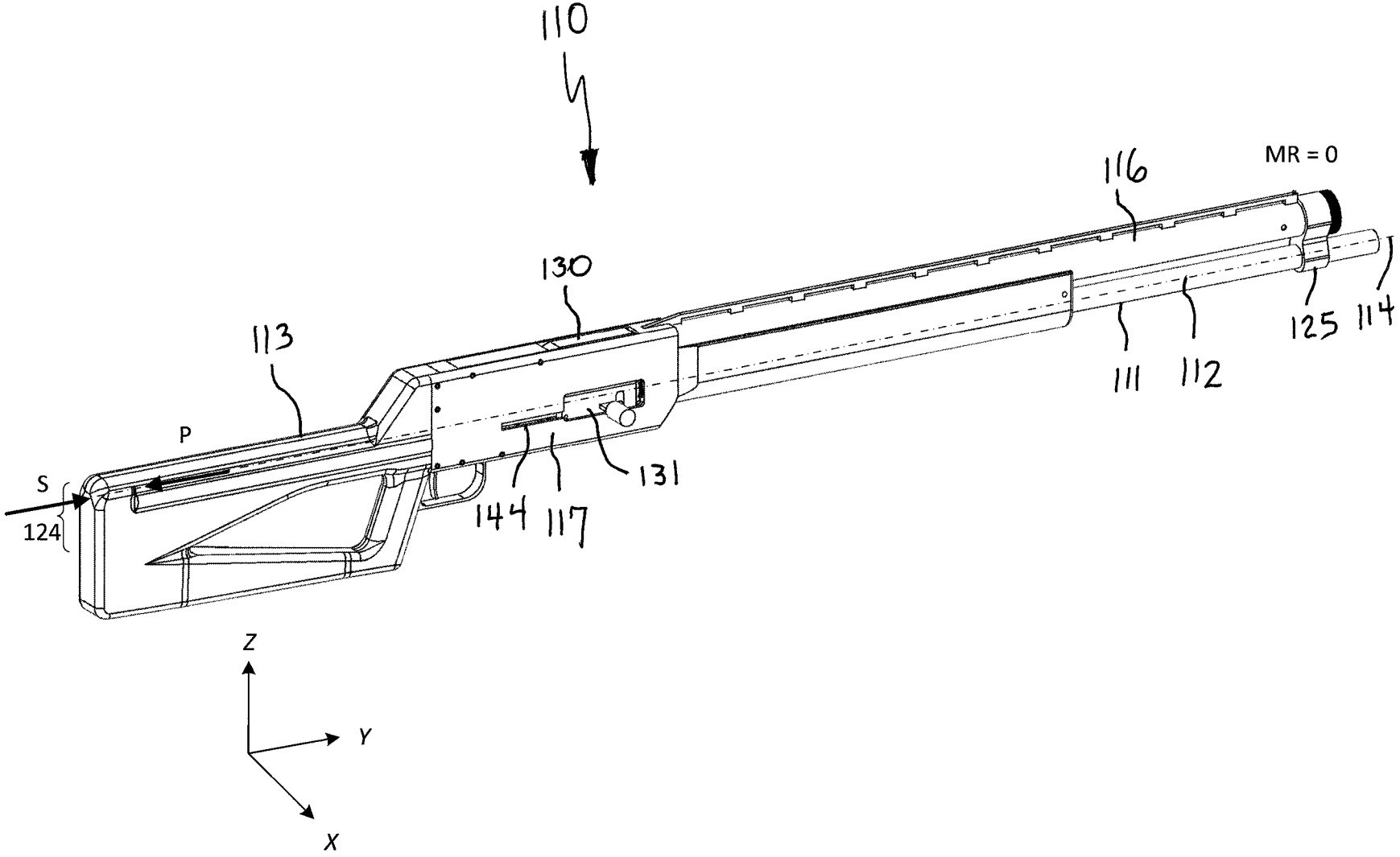
FIG. 2 depicts a side perspective view of a shotgun according to one embodiment of the invention.
Figure 3:
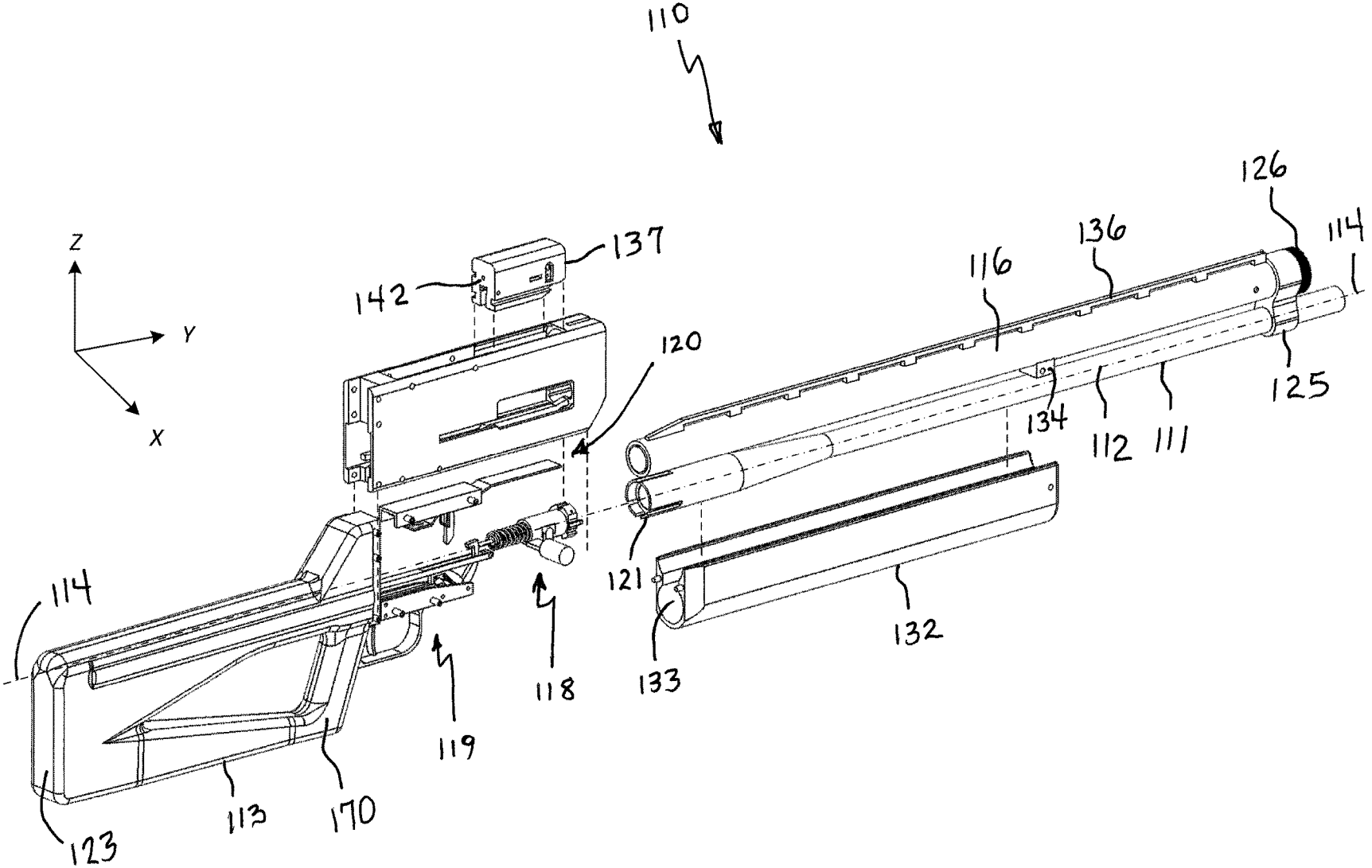
FIG. 3 depicts an exploded perspective view of the shotgun shown in FIG. 2.
Figure 4:
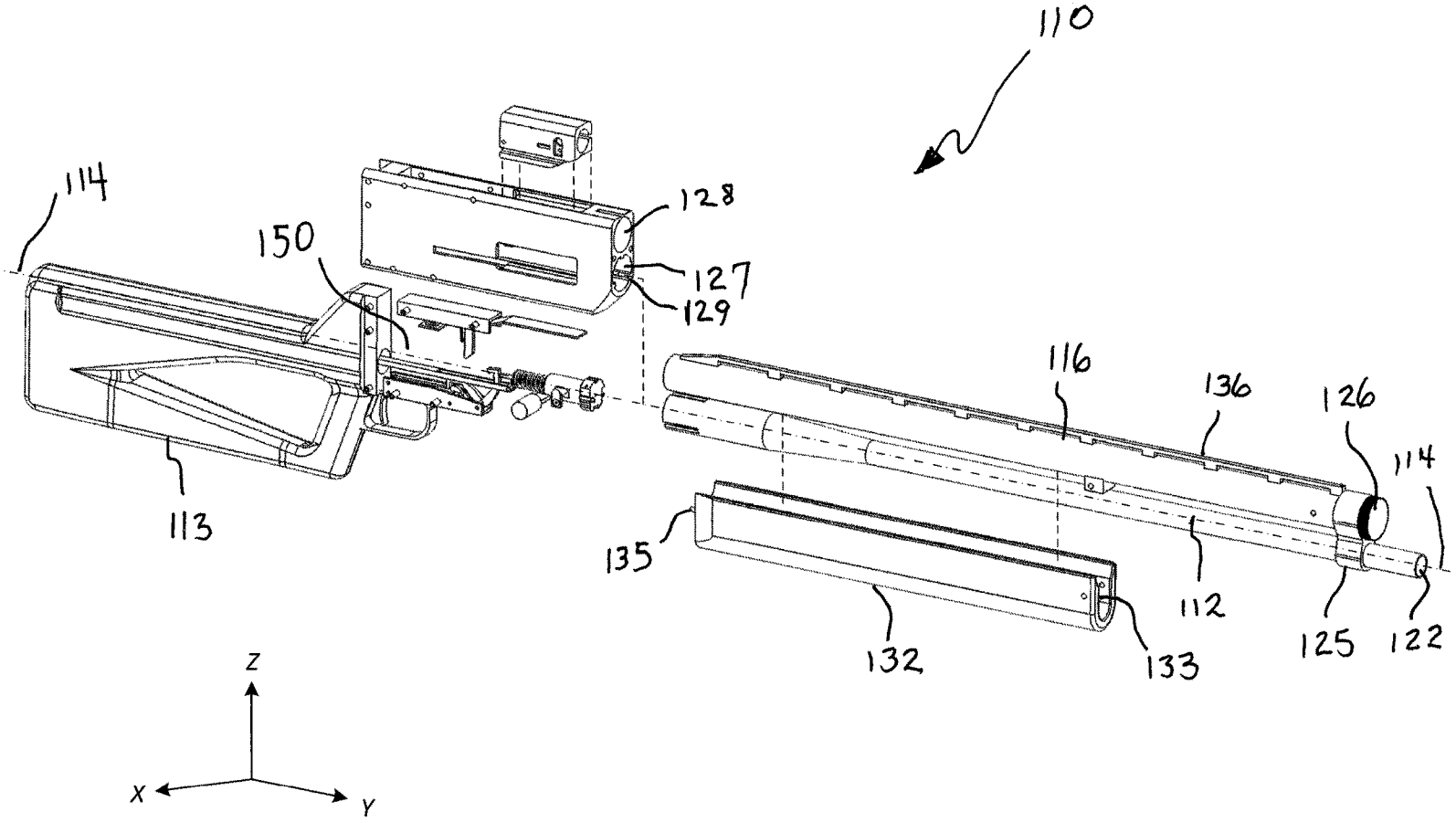
FIG. 4 depicts an alternate exploded perspective view of the shotgun shown in FIG. 2.

FIGS. 2-4 depict the main components of a firearm according to one embodiment of the invention. In the illustrated embodiment, the firearm is a semi-automatic, recoil-operated shotgun. Portions of the shotgun 110 are shown in exploded views (i.e., dashed lines) to better illustrate internal components of the gun.

Generally, the shotgun 110 includes a receiver 117 housing a bolt assembly 118, a trigger assembly 119, and a shell pusher assembly 120. A forward end of the receiver 117 is configured to receive and rigidly secure a breech end 121 of a firearm barrel 111. The barrel 111 extends longitudinally forward from the receiver 117, defining a bore 122 properly sized for the gauge of the shotgun. The bore 122 defines a barrel centerline 112 which, when extended in a longitudinal direction, defines a barrel axis 114.

A rear end of the receiver 117 is configured to receive and rigidly secure a stock 113. The stock 113 may include a butt plate 123 or similar component to provide a degree of added cushion where the stock braces against a user's body, typically the shoulder. For purposes of the invention disclosed herein, the stock 113 defines a body support surface 124 on the butt face where the stock braces against the user's body. In one embodiment, the body support surface 124 is located on the upper portion of the stock 113.

The forward end of the receiver 117 can also be configured to secure a magazine tube 116. The magazine tube 116 can extend longitudinally and store four or five shot shells in a horizontal orientation, and may be secured to the barrel 111 with a barrel clamp 125. An internal magazine spring (not shown) biases the shot shells under spring pressure so as to force the shells rearward into the shell pusher assembly 120 during reload. A threaded end cap 126 holds the compressed magazine spring in place. In one embodiment of the invention, the magazine tube 116 is positioned above the barrel 111. The receiver 117 may thus define a lower opening 127 to receive the barrel 111 and an upper opening 128 to receive the magazine tube 116. The lower opening 127 may include one or more axially-extending ribs 129, lugs, splines, or the like. The outer diameter of the mating barrel and bolt assembly includes matching grooves, thereby allowing the parts to be mated.

In one embodiment of the invention, an upper surface of the receiver 117 can include a top-loading port 130 to load shot shells into the receiver 117, and a side face can include a shell ejection port 131 to eject the spent cartridges. The top-loading port 130, used to load shells into the magazine tube 116, may operate in concert with the shell pusher assembly 120, which can be positioned in line with the longitudinal axis of the magazine tube. The side ejection port 131 allows a spent shell to be side-ejected using the action of the bolt assembly.

In another embodiment, not shown, a side face of the receiver 117 may include both a side-loading port and an ejection port.

The shotgun 110 may further include a fore stock 132 to provide a thermally-insulated grip area for the non-firing hand. The fore stock 132 may be predominately U-shaped in cross-section, defining an internal cavity 133 extending along the barrel axis 114. The cavity 133 can be configured to a depth such that the barrel 111 is fully encased by the fore stock 132. In the illustrated example, the fore stock 132 extends forward approximately half the length of the barrel 111, upwards to the magazine tube 116, and is secured to the receiver 117 and barrel spacer 134 by pins 135.

The shotgun 110 can also include a sighting system 136 mounted atop the magazine tube 116. In the illustrated example, the sighting system 136 is a sight rail extending the length of the magazine tube 116. Because the sighting system 136 is mounted above the magazine tube 116, it is beneficially distanced from the heat emanating off the barrel 111 during firing sequences. As such, the disclosed arrangement can thermally isolate the sighting system 136 from the barrel 111. Users of prior art firearms sometimes encounter barrel mirage, which occurs as heat rises from the barrel, typically when the user fires an excess of 10-15 rounds without a sustained break in-between shots. Barrel mirage distorts the target's image so it appears to be wavering around. Embodiments of the present invention alleviate barrel mirage because the sighting system 136 is thermally isolated from the barrel. No special venting, cooling, or additional hardware is required.

As can be appreciated by comparison of the system forces between FIG. 1 and FIG. 2, the difference in height H between the force P acting along the barrel axis 114 and the reacting force S at the average contact point of the user is essentially zero, meaning little to no torque is generated and the muzzle rise MR is greatly diminished, if not altogether eliminated.

Figure 5:
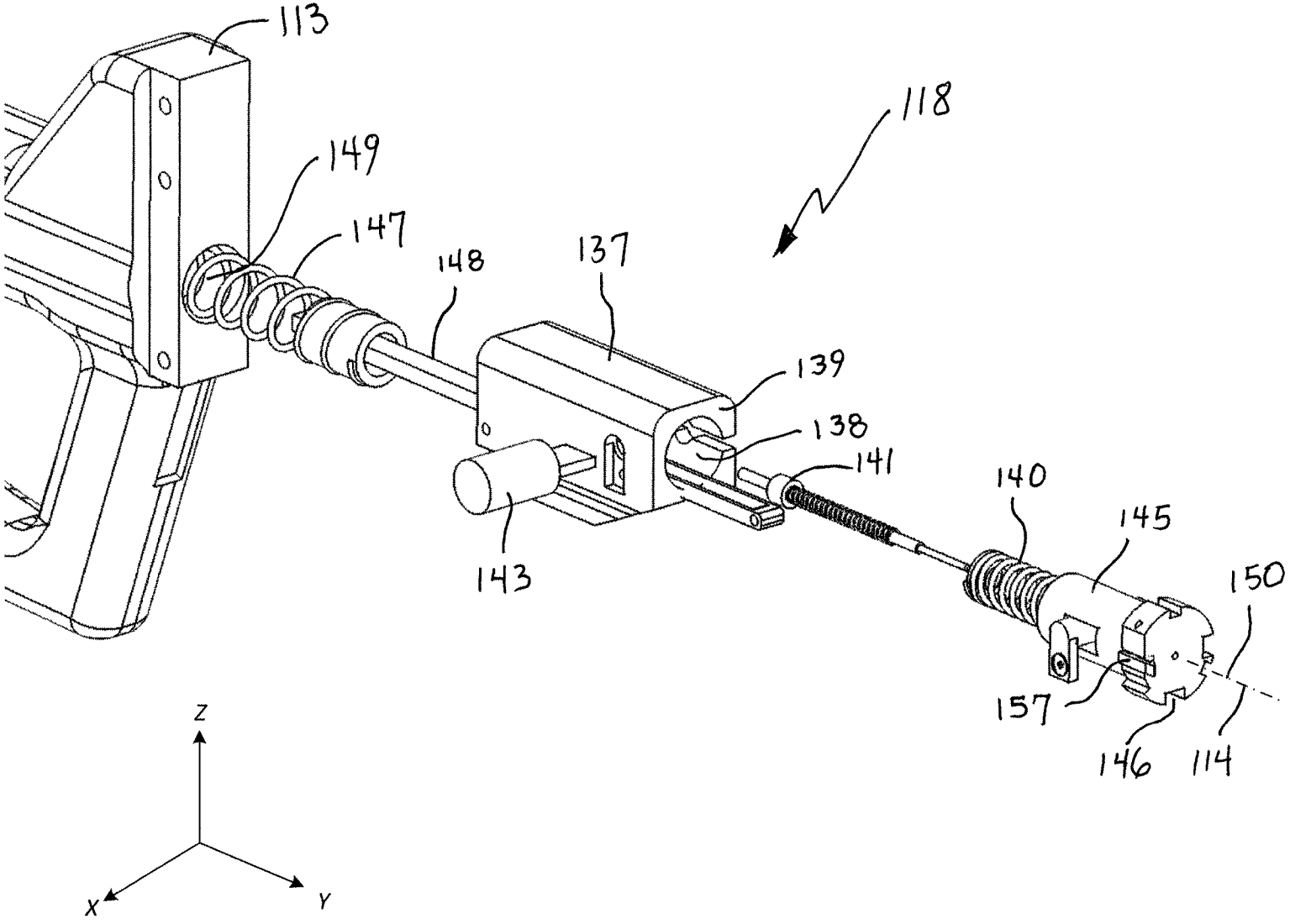
FIG. 5 depicts an exploded perspective view of a bolt assembly according to one embodiment of the invention.

Turning now to FIG. 5, details of the bolt assembly 118 are shown schematically in exploded view, along the barrel axis 114. Bolt assembly 118 holds the shot shell in the breech 121 of the barrel 111 during the firing process. In the illustrated embodiment, the bolt assembly 118 can include a bolt body 137 having an internal cylindrical bolt bore 138 aligned with the barrel axis 114. The bolt bore 138 does not extend completely through the bolt body 137. Rather, the bolt bore 138 is formed into a forward face 139 of the bolt body 137 and extends only part-way through, so as to form a cylindrical cavity with a rear wall. The interior rear wall can be counter-bored to a suitable diameter to accept a bolt spring 140. In one example, the bolt spring 140 may be formed from Type 302 stainless steel to provide a high degree of stiffness. A firing pin 141 extends through a smaller bore 142 in the bolt body 137 (on the rear face) and is also aligned with the barrel centerline barrel axis 114. The firing pin 141 can have a shoulder at an intermediate location to limit its travel within the bolt bore 138.

The bolt body 137 may further include a slot configured to receive a bolt handle 143. As seen in FIG. 2, the bolt handle 143 protrudes through the side ejection port 131 in the receiver 117. A longitudinal slot 144 extending from the ejection port 131 permits the bolt handle 143 to slide the bolt assembly 118 rearward far enough so that a round can be chambered by the bolt action, either manually or automatically.

The bolt assembly 118 may further include a cylindrical bolt head 145 at the forward end of the assembly. The rear portion of the bolt head 145 is configured for a slip-fit in the bolt bore 138 of the bolt body 137 and, when assembled in the bore, captures the bolt spring 140 within the internal cavity. The forward end of the bolt head 145 is configured to mate with ribs 129 on the lower opening 127 of the receiver 117, and include matching grooves 146 disposed about the outer diameter for this purpose. The bolt head 145 secures a shot shell in the breech end 121 of the barrel 111. Forces from recoil spring 147 act on the bolt head 145 and serve to push the bolt head against the chambered round.

A plunger 148 operatively attached to the bolt body 137 extends rearward from the bolt body 137, terminating in a buffer tube 149 located in the stock 113. The plunger 148 engages the recoil spring 147 retained within the buffer tube 149. As will be explained in more detail below, when a shot is fired the recoil force thrusts the bolt body 137 rearward along a bolt path 150 and compresses the recoil spring 147. In most arrangements, the bolt path 150 is along the barrel axis 114. When the recoil forces abate, the energy stored in the compressed recoil spring 147 pushes the bolt assembly 118 forward.

Figure 6:
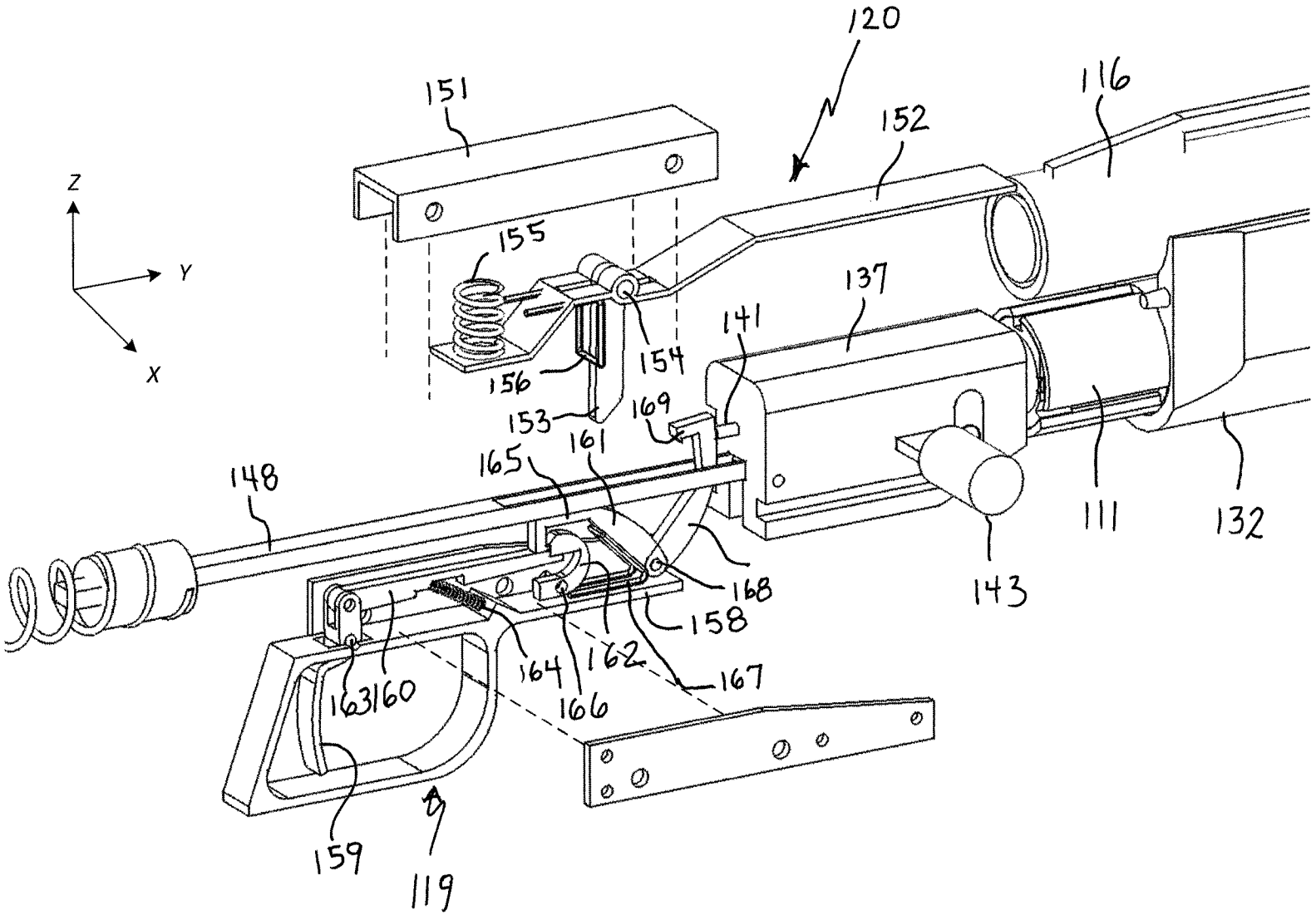
FIG. 6 depicts a magnified exploded perspective view of the shotgun shown in FIG. 3.

FIG. 6 depicts an exploded perspective view of the shell pusher assembly 120 and the trigger assembly 119. The receiver has been removed for clarity. The shell pusher assembly 120 may have dual functions—for use in loading shells into the magazine tube, and to cycle a new round into the chamber after firing.

The shell pusher assembly 120 may be enclosed in a housing formed by a top plate 151 having two sides. The shell pusher assembly 120 may include a pusher plate 152 and a pusher arm 153 that rotate about a pivot pin 154, but may operate independent of each other. The pusher plate 152 closes off the top-loading port 130 of the receiver 117, and therefore is biased upwards by first pusher spring 155. The pusher arm 153 rotates rearward when engaged by the bolt assembly 118, and is biased by second pusher spring 156.

Shot shells can loaded into the magazine tube 116 simply by pressing down on the pusher plate 152 and sliding the shells into the tube. The shell to be fed into the chamber is held in place by a cartridge stop (not shown), a spring-like clip on the inside wall of the receiver 117.

The semi-automatic nature of the firearm allows for automatic cycling of new rounds into the chamber. After a shot is fired, the bolt body 137 rapidly moves rearward and engages the angled surface of the pusher arm 153. The action first depresses the cartridge stop into a depression in the wall of the receiver 117. The deflection disengages the cartridge stop from the rim of the shot shell in the magazine, so the shell pops into the receiver cavity. The continued rearward action of the bolt body 137 subsequently rotates the pusher arm 153 far enough (toward the stock) to pivot the forward portion of the pusher plate 152 downward, which pushes the shot shell down into the chamber. When the bolt returns, a spring-loaded extractor 157 on the bolt head 145 grips and holds the lip of the shot shell, and pushes it into the chamber. When the next round is fired and the bolt slides rearward, the extractor 157 pulls out the spent shell. On the opposing side of the bolt head 145, the receiver 117 has a lug on the side wall, and the bolt has a longitudinal clearance slot. When the bolt slides backwards, still carrying the shell, the lug traverses the slot but eventually hits the lip of the shot shell, causing it to torque over to the side, which is enough to release the extractor spring 157, and the shell is ejected out the side ejection port 131.

The shotgun 110 further includes a trigger assembly 119, which may be a stand-alone, modular construction. Seen externally, the trigger assembly 119 can include a trigger frame 158 and trigger 159. In the disclosed embodiment, the trigger assembly 119 is a three-part system comprising a trigger arm 160, a hammer 161, and a sear 162. The trigger 159 pivots about trigger pin 163, and is also rotatably pinned to the trigger arm 160. Trigger spring 164 biases the trigger arm 160 upwards and backwards, so the forward end remains in biasing contact with hammer and sear 162. The biasing force assures the sear 162 holds the hammer 161 in a cocked position 165. When trigger 159 is pulled backwards, the trigger arm 160 moves forward and pushes on the sear 162, causing it to rotate about the sear pin 166, downwards and away from the hammer. Once the sear 162 moves clear of the hammer 161, the hammer is released and hammer spring 167 biases the hammer to rotate rapidly about hammer pin 168 and strike the firing pin 141, as illustrated by strike position 169.

In operation, the user racks the bolt handle 143 to chamber a round, takes proper stance, and puts the shotgun in firing position, holding the grip 170 with the firing hand and the fore stock 132 with the non-firing hand. The upper portion of the stock butt plate 123, having the body support surface 124, is pulled firmly into the pocket formed in the user's shoulder. In this manner, the barrel axis 114 of the shotgun barrel is directly aligned with the user's area of support.

When the user squeezes the trigger, the firing pin 141 is driven forward through the smaller bore 142 in the bolt body 137 and into the primer of the shot shell, which causes detonation of the chambered shell. The explosive gases and shot exiting the muzzle set up the recoil impulse down the barrel 111 towards the user. Because the bolt body 137 is not fixed to the barrel 111, initially it remains stationary as the rest of the shotgun, including the bolt head 145, begins to recoil backwards. The difference in motion between the stationary bolt body 137 and the rest of the firearm compresses the short, very stiff bolt spring 140 between the bolt body 137 and the bolt head 145. The bolt spring 140 passes the point of maximum compression as the shot charge leaves the barrel and the rearward force on the gun diminishes. The potential energy stored in the compressed bolt spring 140 then releases, expanding the spring and throwing the bolt body 137 rearward with enough force to eject the spent shell, all while compressing the recoil spring 147 in the stock 113.

As the bolt body moves rearward, it also re-cocks the hammer. The rearward-moving bolt body pushes against the hammer 161, causing it rotate in a rearward motion about hammer pin 168. The hammer briefly rotates past its original position 165, and in doing so pushes down on the trigger arm 160, forcing the forward tip of the trigger arm 160 over and past the sear engagement features, and into the middle void of the "C" cross section. A sear spring (not shown) biasing the sear 162 rearward about sear pin 166 permits the sear to rotate rearward until it contacts the hammer 161.

At this point, the recoil spring 147 initiates recycling by sending the bolt assembly 118 forward. When the bolt clears the hammer 161, the hammer spring 167 pushes the hammer upwards until the lip on the hammer engages the lip on the sear, and the opposing biasing forces keep them engaged. In a final step, the user discontinues squeezing the trigger, and trigger spring 164 biases the trigger forward and the trigger arm 160 rearward. As the trigger arm moves rearward, eventually the tip of the sear 162 drops into the shelf on the tip of the trigger arm, and the hammer, sear, and trigger arm mutually lock into place. The trigger assembly is now ready for firing again.

In the embodiment just disclosed, the barrel is rigidly secured to the receiver, and thus immobilized from recoil forces. However, this particular configuration is not intended to limit the invention in any way, and other configurations are contemplated within the scope of the invention.

Figure 7:
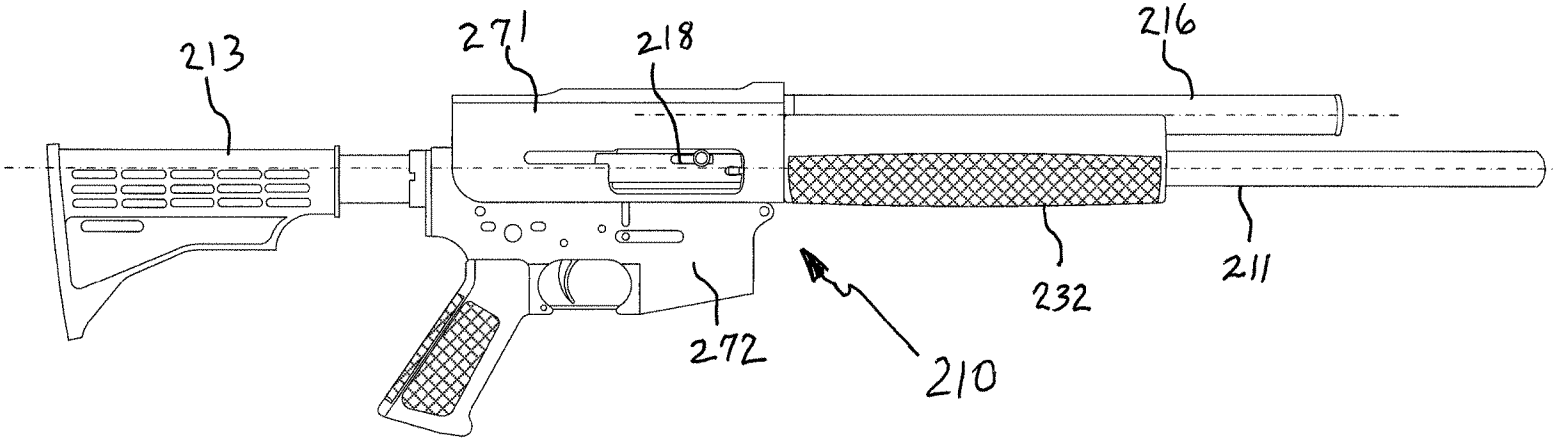
FIG. 7 depicts a side plan view of a shotgun according to another embodiment of the invention.

Turning now to FIG. 7, shown is shotgun 210 according to one embodiment of the invention in which the receiver comprises an upper receiver 271 coupled to a lower receiver 272. The modular arrangement allows for a wider variety of components for user preference, and may permit manufacturing cost savings by modifying existing receivers. In one example, the lower receiver 272 may include the trigger assembly 219 and pistol grip 273, and the upper receiver 271 may include the bolt assembly 218 and shell pusher assembly 220 (hidden from view). The barrel 211, magazine tube 216, fore end 232, and stock 213 could be customized or off-the shelf.

Figure 8:
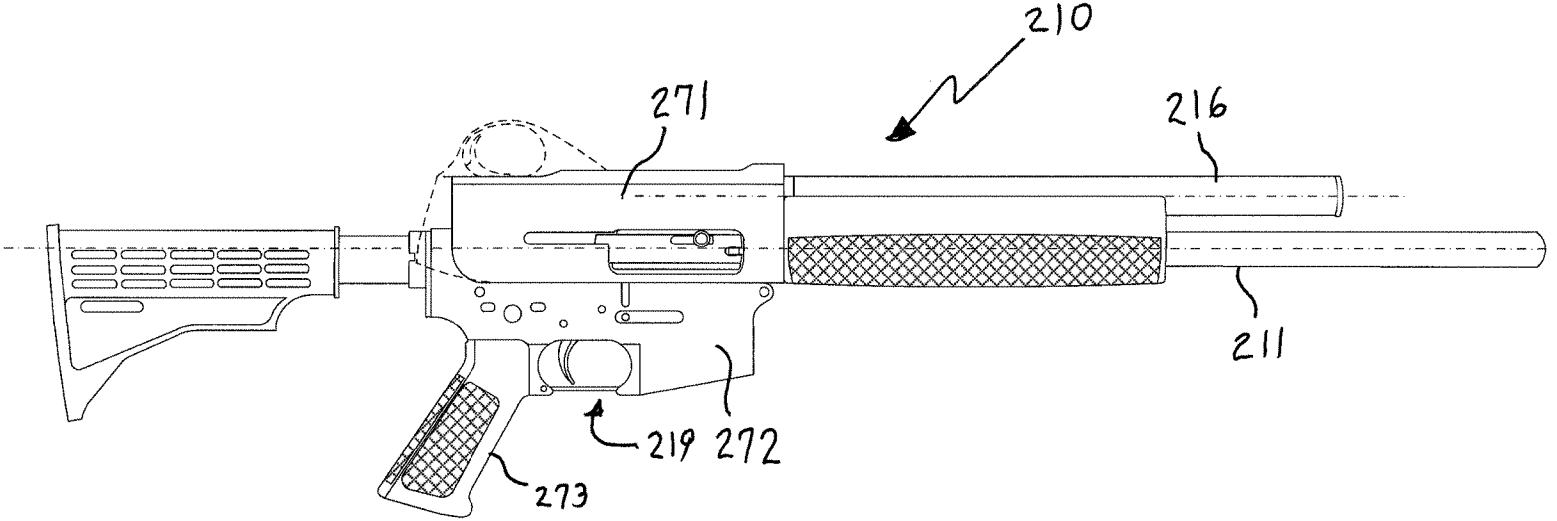
FIG. 8 depicts an alternate plan view of the shotgun shown in FIG. 7.

In one example, shown in FIG. 8, the lower receiver 272 can be configured as an AR-type lower receiver, and the upper receiver 271 can be configured as a shotgun upper receiver. As illustrated, in one possible arrangement the shotgun upper receiver 271, barrel 211, and magazine tube 216 were rotated upside-down to be fitted into the lower receiver 272. The dashed lines indicate removal of the trigger assembly and metal removal from the receiver to conform to the shape of the AR-type lower receiver 272.

Although a single-barreled, semi-automatic shotgun has been described above, other shotgun variants are contemplated within the scope of the present invention. For example, the shotgun may be double barreled, or breech-loading with break-action. The shotgun may be pump-action, lever-action, bolt-action, fully automatic, gas-operated, or recoil-operated.

Figure 9:
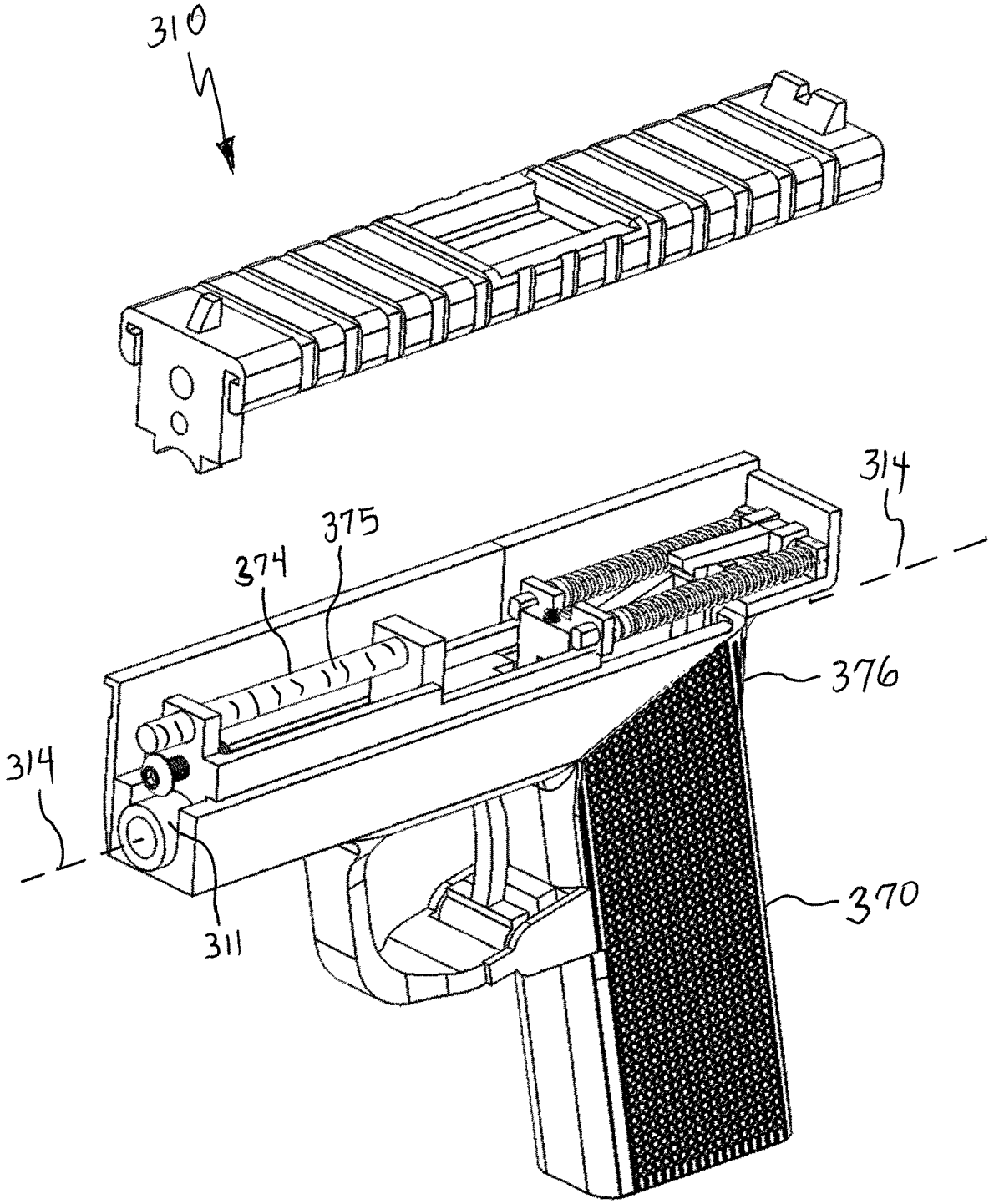
FIG. 9 depicts a perspective view of a pistol according to another embodiment of the invention.

Furthermore, other firearms besides a shotgun are contemplated within the scope of the present invention. For example, the firearm may be a semi-automatic pistol. As illustrated in FIG. 9, wherein like numerals indicate like elements from FIGS. 1-8, to mitigate the muzzle rise on a pistol 310, the location of the barrel and guide rod can be swapped, such that the guide rod 374 and spring 375 are positioned above the barrel 311. The barrel axis 314 can be configured to align with the web 376 of the grip 370. In this manner, the force from the projectile and propellant gases acting along the barrel axis 314 are resisted essentially along the axis of the user's outstretched forearm.

Figure 10:
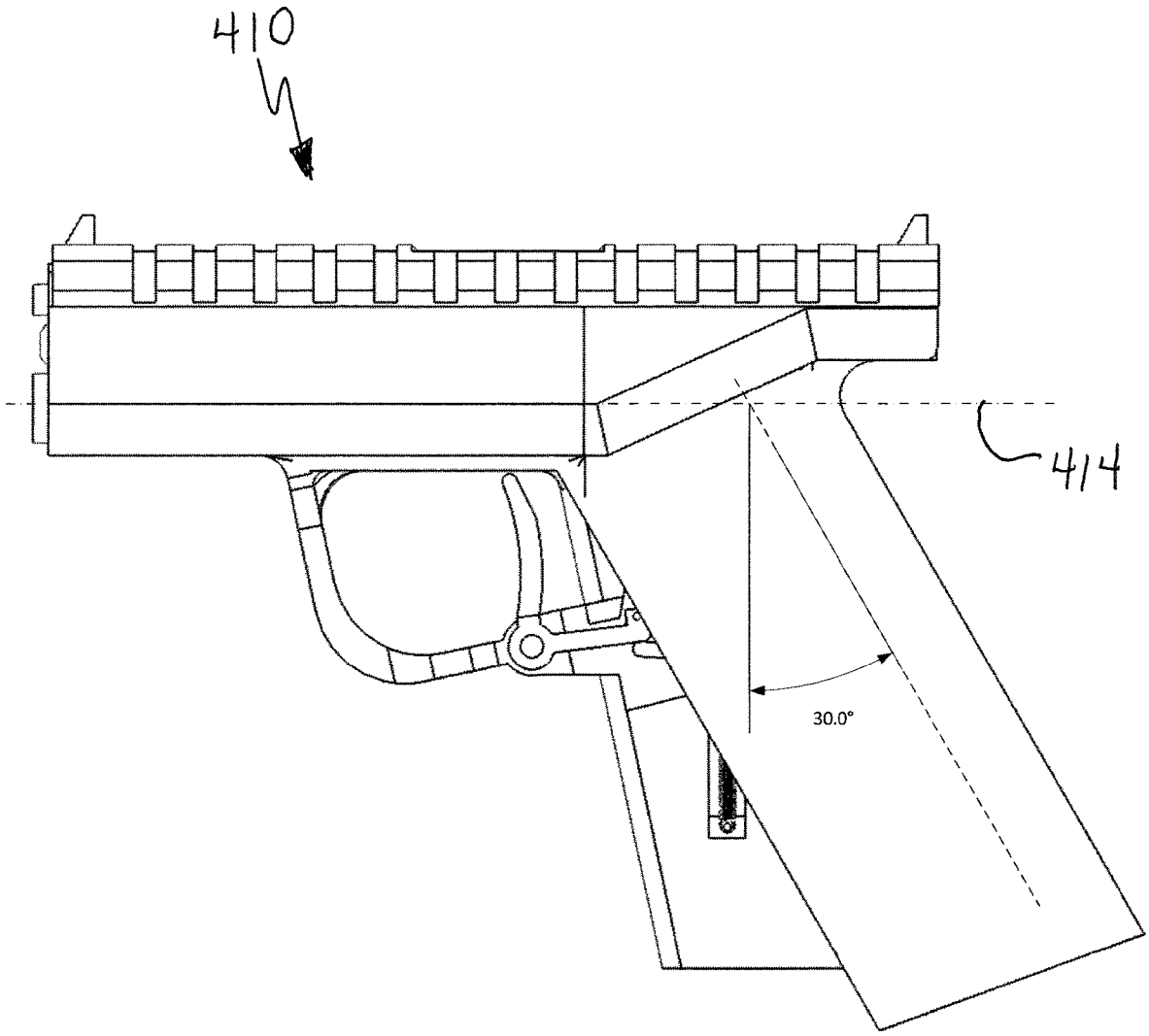
FIG. 10 depicts a side plan view of a pistol according to yet another embodiment of the invention.

Turning to FIG. 10, in other embodiments the grip angle $\alpha$ can be increased to approximately 30° or more, which may better align the barrel axis 414 with the user's forearm. As used herein, grip angle is defined as the angle between the grip and a line perpendicular to the sight plane (or barrel centerline).

A sample of devices and methods that are described herein are as follows:

A method for reducing muzzle rise in a firearm, the method comprising the steps of:

providing a stock defining a body support surface;

operatively coupling a receiver to the stock;

operatively coupling a barrel to the receiver, the barrel defining a centerline extending along an axis;

aligning the barrel axis with the body support surface of the stock; and positioning a magazine tube atop the barrel.

The method above, further comprising the step of positioning a sighting system atop the magazine tube.

The method according to claim 0, further comprising the step of configuring a shell pusher assembly to drop a new round from the magazine tube downwards into the receiver.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

The invention claimed is:

1. A firearm having reduced muzzle rise, comprising:

a barrel having a breech end, an opposing muzzle end, and a bore defining a barrel centerline which, when extended in a longitudinal direction, defines a barrel axis;

a magazine tube disposed in spaced apart relationship relative to the barrel, the spaced apart relationship being in a first direction extending normal from the barrel centerline;

a receiver defining a lower opening to which the barrel is secured and an upper opening to which the magazine tube is secured; the receiver comprising:

a bolt assembly positioned along the barrel centerline, configured to hold a chambered round in place during a firing sequence, the bolt assembly comprising a bolt body and a bolt head operatively coupled to the bolt body; and a shell pusher assembly for use in guiding a new round from the magazine tube into the barrel, the shell pusher assembly comprising a pusher plate biased away from the barrel centerline in said first direction, and a pusher arm pivotably coupled to the pusher plate, the pusher arm being biased toward the breech end of the barrel;

a stock secured to a rear end of the receiver, the stock defining a body support surface where the stock braces against a user's body, wherein the barrel centerline passes through the body support surface; and wherein, responsive to the bolt assembly action, the bolt body engages the pusher arm, overcomes the bias on the pusher arm and pusher plate, and drives the pusher plate to guide the new round into the barrel.

2. The firearm according to claim 1, further comprising a sighting system mounted to the magazine tube.

3. The firearm according to claim 2, wherein the sighting system is a sight rail extending the length of the magazine tube.

4. The firearm according to claim 1, wherein a surface of the receiver defines a top-loading port, and the pusher plate is biased in said first direction to close off the top-loading port so as to use the shell pusher assembly for loading shells into the magazine tube.

5. The firearm according to claim 1, further comprising a trigger assembly, the trigger assembly comprising:

a trigger frame secured to the receiver;

a trigger pivotably coupled to the trigger frame;

a trigger arm comprising a first end and an opposing second end, the first end coupled to the trigger;

a sear in biasing engagement, while in a cocked position, with the second end of the trigger arm; and a spring-loaded hammer held in the cocked position by the sear;

whereupon pulling the trigger moves the trigger arm and sear, thereby releasing the hammer to strike a firing pin.

6. The firearm according to claim 5, wherein the shell pusher assembly is disposed in spaced apart relationship relative to the barrel centerline in said first direction, and the trigger assembly is disposed in spaced apart relationship relative to the barrel centerline in a second direction, opposite said first direction.

7. The firearm according to claim 5, further comprising a trigger spring secured to the trigger frame, the trigger spring biasing the trigger arm towards the stock to return the trigger to a cocked position.

8. A shotgun having reduced muzzle rise, comprising:

a barrel having a breech end, an opposing muzzle end, and a bore defining a barrel centerline which, when extended in a longitudinal direction, defines a barrel axis;

a stock defining a body support surface where the stock braces against a user's body;

a receiver operatively coupled to the stock and the barrel, the receiver defining a lower opening aligned with the barrel axis to receive the barrel;

a shell pusher assembly disposed within the receiver for use in guiding a new round into the barrel;

a bolt assembly having a bolt path aligned with the barrel axis, and configured to hold a chambered round in place during a firing sequence, the bolt assembly comprising a bolt body and a bolt head operatively coupled to the bolt body;

a trigger assembly comprising a trigger and a trigger frame;

wherein the shell pusher assembly and the trigger assembly are disposed in opposing spaced apart relationship relative to the barrel centerline; and wherein the bolt assembly is positioned nearer to the muzzle end than the trigger assembly.

9. The shotgun according to claim 8, wherein the receiver comprises an upper receiver coupled to a lower receiver.

10. The shotgun according to claim 9, wherein the lower receiver comprises the trigger assembly, and the upper receiver comprises the bolt assembly.

11. The shotgun according to claim 9, wherein the lower receiver is configured as an AR-type lower receiver, and the upper receiver is configured as a shotgun upper receiver.

12. The shotgun according to claim 8, the trigger assembly further comprising:

a trigger arm comprising a first end and an opposing second end, the first end coupled to the trigger;

a sear in biasing engagement, while in a cocked position, with the second end of the trigger arm; and a spring-loaded hammer held in the cocked position by the sear;

whereupon pulling the trigger moves the trigger arm and sear, thereby releasing the hammer to strike a firing pin.

13. The shotgun according to claim 12, wherein the trigger arm is pivotably coupled to the trigger, the sear is pivotably coupled to the trigger frame, and the hammer is pivotably coupled to the trigger frame.

14. The shotgun according to claim 8, further comprising a magazine tube, the receiver further defining an upper opening, the magazine tube aligned with the upper opening and secured to the receiver.

* * * * *